United States Patent [19]

Parry et al.

[11] 4,334,675

[45] Jun. 15, 1982

[54] GYMNASIUM APPARATUS

[76] Inventors: Charles G. Parry, 208 Greenbriar Rd., North Syracuse, N.Y. 13212; David L. Sherwood, 3630 S. Maplewood Dr., Apt. B, Tulsa, Okla. 74135

[21] Appl. No.: 86,650

[22] Filed: Oct. 22, 1979

[51] Int. Cl.[3] ..... A63B 3/00

[52] U.S. Cl. ..... 272/63

[58] Field of Search ..... 272/85, 78, 61-64, 272/109-113, 93, 29; 273/1.5 R; 248/370, 533, 188.91, 351, 188.6, 165; 211/189; 182/172, 173, 179

[56] References Cited

U.S. PATENT DOCUMENTS

| | | | |
|---|---|---|---|
| 399,632 | 3/1889 | Reach | 272/62 |
| 694,442 | 3/1902 | Suder | 272/63 X |
| 2,817,522 | 12/1957 | Margulies | 272/62 X |
| 2,944,815 | 7/1960 | Moyer | 272/61 X |
| 3,117,760 | 1/1964 | Dresbach et al. | 272/61 X |
| 3,232,609 | 2/1966 | Nissen et al. | 272/63 |
| 3,384,368 | 5/1968 | Fenner et al. | 272/62 |
| 3,653,658 | 4/1972 | Robertson | 272/63 |

FOREIGN PATENT DOCUMENTS

| | | | |
|---|---|---|---|
| 241680 | 8/1946 | Switzerland | 272/109 |

*Primary Examiner*—Richard J. Apley
*Attorney, Agent, or Firm*—Bruns & Jenney

[57] ABSTRACT

Apparatus for securely supporting an exercise bar that includes a pair of opposed locking units having a base section and a vertical post in which the bar is adjustably suspended above the floor. Compression rods are connected between the top of the post and the outer extremities of the base. Each post is carried in the base by a slide mechanism that can be locked in a desired position to prestress the entire system so that the base of each locking unit is forced downwardly against the floor. Added forces that are exerted upon the system by a performer mounted upon the bar are translated by the rods into the base sections to further enhance the holding power of the system against the floor.

11 Claims, 6 Drawing Figures

GYMNASIUM APPARATUS

BACKGROUND OF THE INVENTION

This invention relates to gymnastic equipment and, in particular, to apparatus for rigidly supporting one or more horizontal exercise bars above the floor of a gymnasium without having to secure the equipment to the floor with tie-down wires, weights and the like.

Most gymnastic devices of the parallel bar type that are in use today require some means to physically secure the equipment against the floor in order to provide the performer with a stable platform upon which to work. In many cases the apparatus is physically tied to the floor by means of a complex system of tie-down cables and turnbuckles. The cables are typically attached to the vertical posts supporting the bar and are lagged to the floor by means of bolts. By use of the turnbuckles, the wires are placed in tension to continually pull the equipment against the floor. When forces are exerted upon the bar, more tension is placed upon some of the cables while others become relatively slack. As a consequence, part of the equipment tends to lift from the floor creating a disturbing, unstable condition that can adversely affect the performer. Similarly, loading and unloading of the cables tends to stretch the cables and requires constant adjusting of the turnbuckles.

Large weights are sometimes used to secure this type of equipment to the floor. Here again, the idea is to statically load the gymnastic device against the floor with sufficient holding power to prevent it from unduly moving during a performance. These weights are typically large and thus difficult to transport and store. More important, the large weights pose a constant danger to a person using the equipment or to any one performing exercises in the surrounding area.

Nissen et al in U.S. Pat. Nos. 3,232,609 and 3,473,801 disclose a bracing arrangement for providing added stability to a parallel bar system. Braces are connected at one end to the pistons supporting one of the bars and at the other end to the base of the apparatus. The braces extend outwardly to one side of the bar and are designed to prevent the apparatus from tipping over when overstressed in this one particular direction.

SUMMARY OF THE INVENTION

It is therefore an object of the present invention to improve gymnastic equipment for supporting one or more exercise bars above the floor of a gymnasium.

A further object of the present invention is to provide a stable parallel bar system that can be easily transported and stored.

Another object of the present invention is to provide exercise equipment of the parallel bar type that does not rely upon complex weighting or tie-down devices for its stability.

A still further object of the present invention is to increase the stability of a parallel bar system by utilizing the forces generated by a performer using the equipment to more securely hold the equipment against the support surface against which it is resting.

Yet another object of the present invention is to improve the safety of gymnastic equipment used to support one or more raised exercise bars.

These and other objects of the present invention are attained by means of gymnastic apparatus that includes a pair of opposed free-standing locking units each of which has a base section and at least one vertical post secured thereto for supporting one end of an exercise bar above the support surface upon which the base is resting. A pair of compression rods are extended from the top section of each post to the outer extremities of the base. The rods, in assembly, are placed under a compressive load whereby forces exerted upon the system are transmitted downwardly into the base to provide a greater holding force against the support surface.

BRIEF DESCRIPTION OF THE DRAWINGS

For a better understanding of these and other objects of the present invention reference is had to the following detailed description of the invention that is to be read in conjunction with the accompanying drawings wherein.

DESCRIPTION OF THE INVENTION

Figure 1:
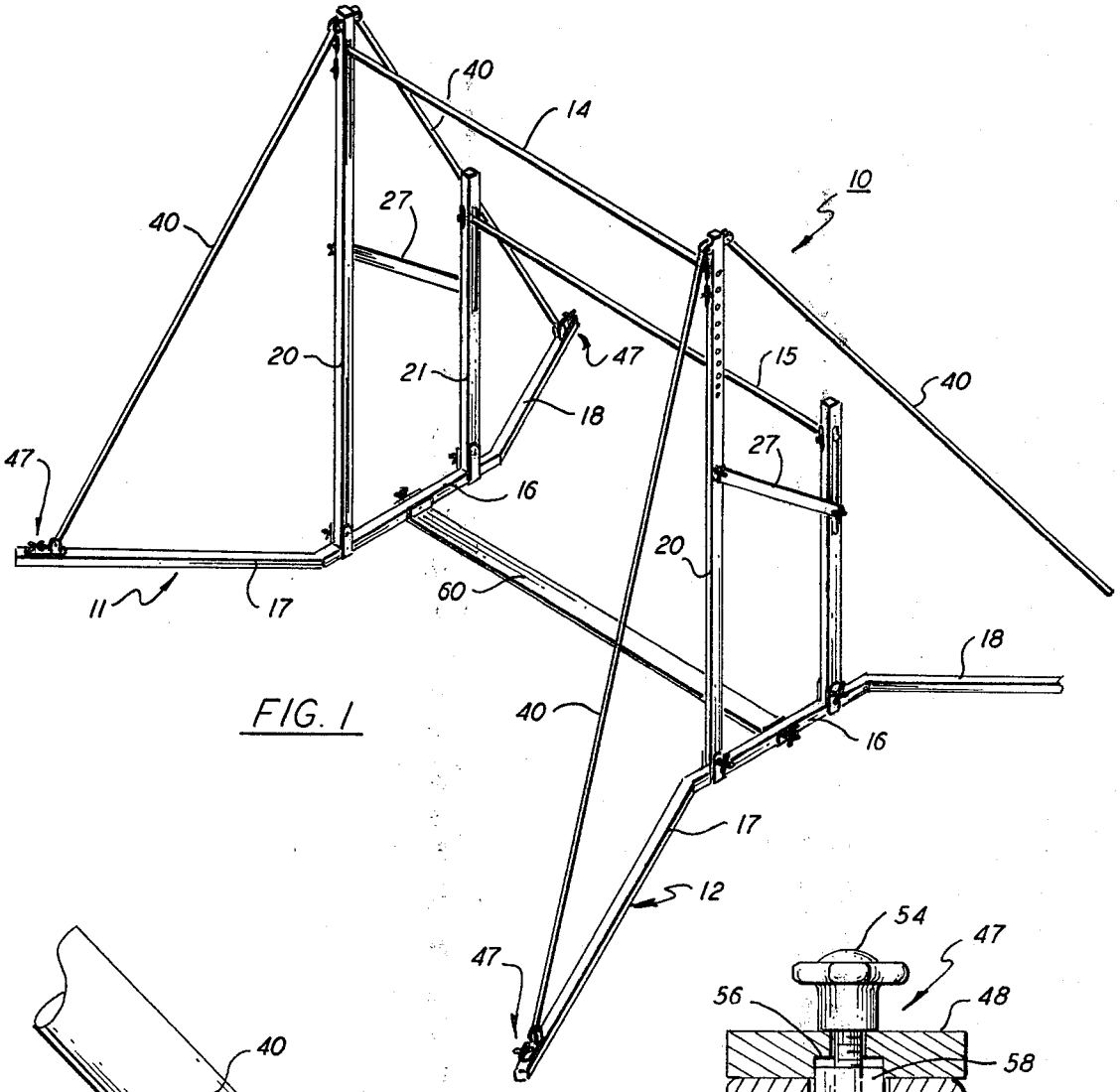
FIG. 1 is a perspective view of gymnastic equipment embodying the teachings of the present invention.
Figure 5:
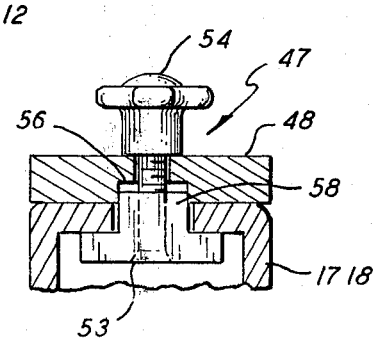
FIG. 5 is a section taken along lines 5—5 in FIG. 4.

Referring initially to the drawings, and in particular to FIG. 1, there is shown a piece of gymnastic equipment 10 for supporting one or more parallel bars above the floor of a gym or the like. The equipment involves two opposed locking units 11, 12 that are free-standing assemblies between which parallel bars 14 and 15 are suspended. Each locking unit includes a base section that rests upon the floor of the gym. Each base contains a central member 16 and two outwardly extended arms 17 and 18. Although not shown, the base sections are also provided with rest pads upon which they may be seated to prevent the floor from being damaged.

Figure 3:
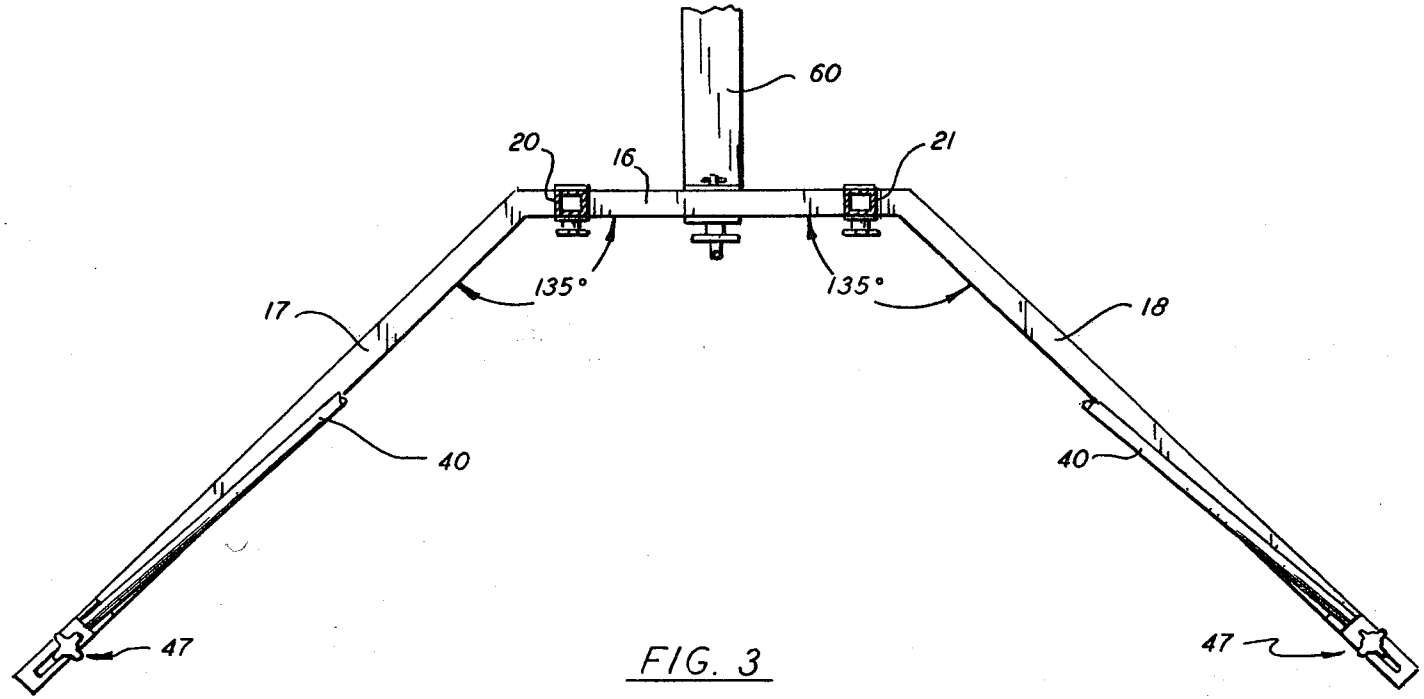
FIG. 3 is a top plan view with portions broken away showing one of the two locking units utilized in the equipment illustrated in FIG. 1.

The central member of each locking unit is located in assembly in perpendicular alignment with the parallel bars. The arms of each unit are secured to the ends of the central member and extend obliquely away from the member as best shown in FIG. 3. Preferably, the arms form an included angle of about 135° with the outer side edge of the central member. The length of each arm is about twice the axial length of the central member. Accordingly, the two locking units, when cojoined to the bars in the manner to be described below, will provide a stable platform for a person performing exercises thereon.

Figure 2:
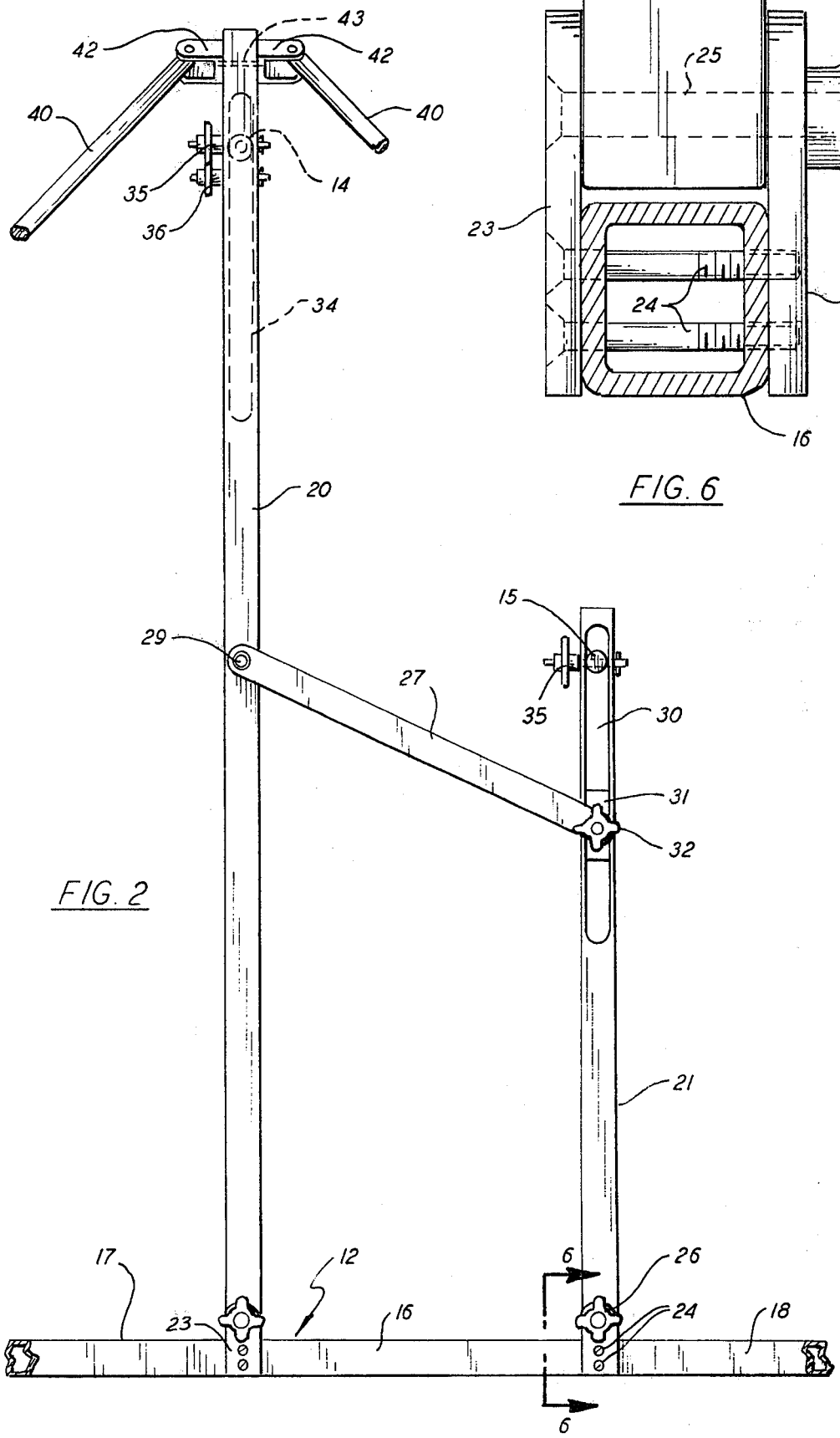
FIG. 2 is an enlarged side elevation of the equipment shown in FIG. 1.
Figure 6:
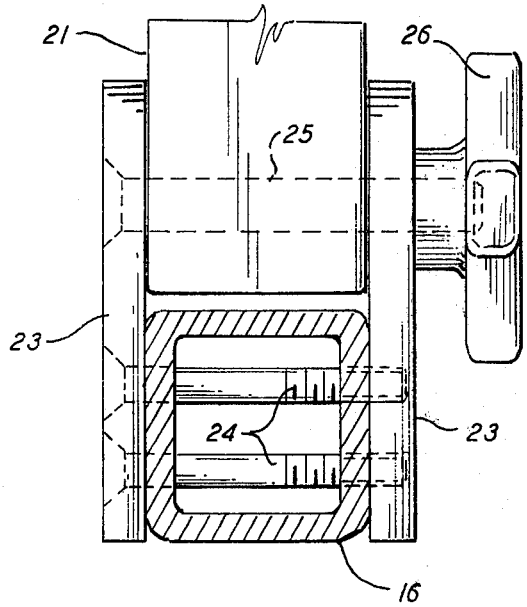
FIG. 6 is a section taken along lines 6—6 in FIG. 2.

A pair of vertically extended posts are spaced apart upon the upper surface of each central member. The posts include a first taller post 20 and a second shorter post 21. As illustrated in FIG. 1, the taller posts coact to support bar 14 therebetween while the shorter posts coact to similarly support the second bar 15. The taller posts are rigidly affixed to the base sections by any suitable means capable of maintaining the posts in a vertical or upright position. The shorter posts, on the other hand, are pivotably supported in the base sections to permit the bar 15 mounted therein to be moved toward or away from the other bar. As shown in FIGS. 2 and 6, the shorter posts are both supported upon the central member of the associated base section between two raised side plates 23—23 that are bolted to the vertical side walls of the member by high strength screws 24—24. Each post is rotatably supported between the plates upon a pivot pin 25. In practice, the pivot pin contains a threaded end section for receiving a hand-operated nut 26. The nut can be hand tightened with sufficient force to secure the post in a vice-like grip between the two plates. By loosening the nut, the angular position of the shorter post upon the central member can be altered to selectively position the bar 15 closer or further away from the bar 14.

A link 27 is pivotably mounted in each of the taller posts by means of a trunion 29 (FIG. 2). The opposite end of the link is slidably carried within a vertical slot 30 passing through the opposing side walls of the shorter posts. It should be pointed out at this juncture that the four posts and the members making up the base section of the locking units are all formed of hollow rectangular sections of tubing. A T-headed bolt 31 is contained within the slot formed in the post which coacts with a hand actuated locking nut 32 to secure the link at a given position. By angularly positioning the shorter posts in regard to the second or taller posts, the lateral distance between the two parallel bars can be easily adjusted.

The parallel bars 14 and 15 are received in vertical slots 30 and 34 formed in the two sets of posts. The slots permit the bars to be vertically raised or lowered in assembly. A series of equally spaced holes are passed through the opposite side walls of each post that are adapted to receive in close sliding relationship therein spring loaded locking pins 35—35. The pins, in operation, are also passed through the ends of the bars to secure them to the posts. To change the elevation of the bar, the pins are simply removed from the assembly, the bar moved to a new position and the pins reinserted into the post. As shown in FIG. 2, safety pins 36 can also be inserted immediately below the bar to intercept the bar in the event one of the main supporting pins fails.

The locking units each include a pair of compression rods 40—40. Each rod is operatively connected at its ends to the upper part of the taller post and the outer extremity of one of the two extended arms included in the base section. A pair of opposed clevis members 42—42 are secured in the upper part of the post by means of a trunnion that permits each clevis member to turn independently about the axial centerline of the trunnion. The upper end of each compression rod is secured in one of the clevis members to permit the rod to turn with the member 43. The opposite end of the rod is slidably mounted at the distal end of the companion arm 17 or 18 by means of a slide mechanism that is generally referenced 47.

Figure 4:
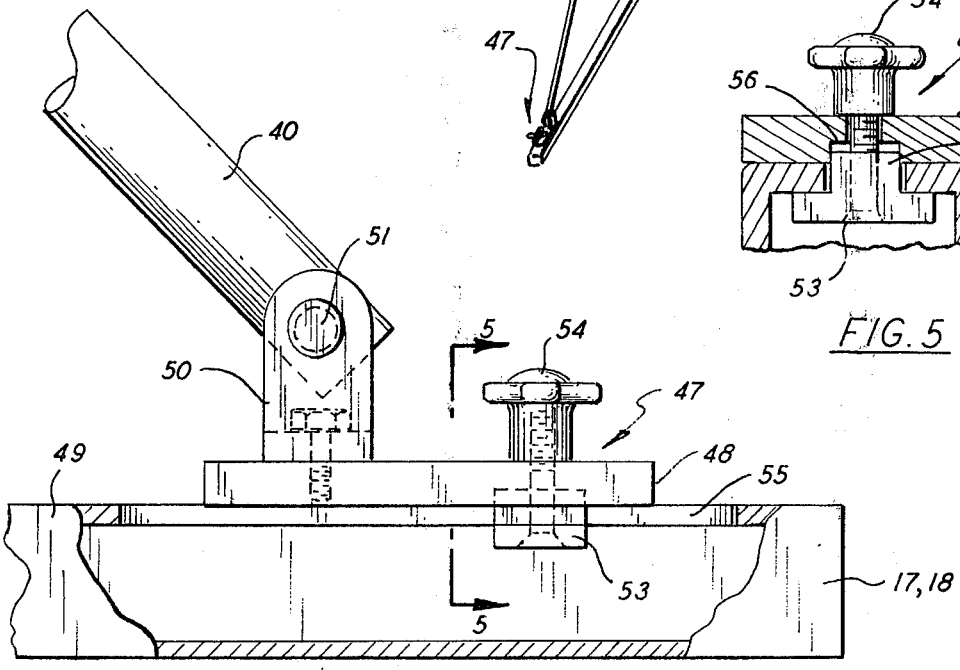
FIG. 4 is an enlarged partial view showing a slide mechanism used to lock each of the compression rods employed in the present apparatus in place.

In operation, the slide is arranged to move axially along the top surface of the arm and includes a main plate 48. A clevis 50 is bolted to the front end of the plate as shown in FIG. 4 and rotatably carries the lower end of the rod 40 therein upon a pivot pin 51. Toward the rear of the plate there is situated a locking device made up of a T-headed bolt 53 and a hand-operated nut 54 that is threaded onto the shank of the bolt. A recess 56 is formed in the bottom of the plate into which the vertical leg of the bolt head is drawn. In assembly, the vertical leg of the bolt is slidably carried in an axially aligned slotted hole 55 formed in the top wall of the underlying arm in close sliding relationship therewith. To lock the slide at a desired position, the nut is tightened down thereby drawing the horizontal leg of the T-head against arm 17, 18. Sufficient force is delivered by the system to securely hold the slide, and thus the rod 40, immobile in assembly.

To assemble the present apparatus, the two locking units are placed in spaced-apart relationship upon a gymnasium floor or the like. This is accomplished by situating the base members 16 in receiving rails carried upon the ends of a spacer element 60 and securing the element to the members by any suitable means. Next the exercise bars 14 and 15 are set to a desired elevation using the pin and hole arrangement described above. Finally, each compression rod 40 is moved along the associated arm toward the supporting post 20 to load the rod in compression between the post and the associated base section. After loading the rods, each slide is locked in place by drawing the T-bolt against the overlying surface of the arm using the hand-operated nut 54.

Under the combined action of the compressed rods the entire assembly is prestressed so that the two base sections are being forced downwardly against the floor. This prestressing of the system serves to securely hold the apparatus in a stable condition. By the same token, when either of the exercise bars is placed under load by a person performing thereon, an added downwardly acting force is translated through the rods to the base sections that reinforces the original holding force. As a result, the present apparatus becomes more secure or stable when placed in use.

While this invention has been described with reference to the details as set forth above, it is not limited to the specific structure as disclosed and the invention is intended to cover any modifications or changes as may come within the scope of the following claims.

We claim:

1. Gymnastic apparatus for maintaining a pair of parallel bars above a support surface including a pair of opposed free-standing locking units that are arranged to support a pair of parallel bars therebetween in a raised position above the support surface, each of said locking units including, a base section that is adapted to rest upon the support surface that has a central member perpendicularly aligned with the bars and an obliquely-turned arm secured to each end of the central member which extends outwardly and away from the ends of the parallel bars, a stationary post secured to the central member of the base section that extends upward in a vertical direction therefrom having means for supporting a first bar therein whereby the first bar is suspended between the locking units, a movable post pivotably secured in the central member of the base section and extending upwardly therefrom having a second means for supporting a second bar therein whereby the second bar is suspended between the locking units, a link adjustably connected between the stationary and the movable post for angularly positioning the movable post in reference to the stationary post, a pair of compression rods mounted in the unit with each rod being rotatably supported at one end in the upper portion of the stationary post by a pivot means and slidably supported at the other end in one of the oblique arms of the base section by a slide mechanism, and locking means acting between the slide mechanism and the arm for locking the slide in a predetermined position.

2. A gymnastic device of the type having a base section that rests upon a support surface, a pair of spaced-apart vertically extended stationary posts secured to the base and an exercise bar suspended between the stationary posts, the improvement comprising a coacting pair of compression rods connected to the upper portion of each stationary post with one rod extending downwardly to the base on one side of the post and the other rod extending downwardly to the base on the opposite side of the post, a slide mechanism connected to the lower end of each compression rod that is slidably supported in the base to move toward and away from the exercise bar, and locking means operatively connected to each slide mechanism for locking the slide mechanism to said base whereby each compression rod can be secured in compression between the base and one of said stationary posts wherein said locking means includes a T-bolt slidably received within a slotted hole formed in the base and a manually-operated nut threaded upon the bolt.

3. The improvement of claim 2 wherein each compression rod is connected to one of the stationary posts by a clevis means that is pivotably supported in said post.

4. The improvement of claim 2 wherein each compression rod extends laterally and rearwardly in relation to one end of the exercise bar.

5. The improvement of claim 2 that further includes adjusting means acting between the exercise bar and the posts for allowing the height of the bar to be changed.

6. A gymnastic device that includes a base that is adapted to rest upon a horizontal support surface, a pair of coacting vertically aligned posts for supporting an exercise bar therebetween, each post being secured at its lower end within the base, each post further having a pair of opposed compression rods associated therewith which extend obliquely to either side of the post between the upper part of the post and the base, pivot means for securely affixing the upper ends of the opposed compression rods in the upper part of the associated post above the exercise bar, means for movably supporting the lower ends of the opposed compression rods within the base to permit the lower ends of the opposed rods to move along individual paths of travel towards each other to load the rods in compression against the base with sufficient force to establish a closed system in which the compression rods are prestressed in assembly so as to continually deliver a holding force to the base to hold the latter against the support surface when a gymnast is exercising on the exercise bar, and locking means associated with said last mentioned means for locking the compression rods to the base at a desired compressive loading position along its path of travel.

7. The gymnastic device of claim 6 wherein each compression rod extends between the top of the associated post and one corner of the base whereby four corners of the base are compressed against the support surface.

8. The gymnastic device of claim 6 wherein the exercise bar is adjustably supported between the post whereby the height of the bar above the support surface can be varied, the maximum height of the bar being substantially equal to the top of the compression rods.

9. A gymnastic device of claim 6 that further includes a second pair of vertically aligned posts also secured in the base and being spaced apart from said previously noted pair, and a second exercise bar supported between the posts of said second pair.

10. A gymnastic device that includes a base that is capable of resting upon a horizontal support surface, a pair of parallel posts secured in the base and rising upwardly therefrom in a vertical direction, an exercise bar supported between the post, a pair of opposed rods secured to the upper part of each post above the exercise bar and extending obliquely to the base, and means for locking each of the rods in compression against the base with sufficient force to establish a closed system in which the compression rods are prestressed in assembly so as to continually deliver a holding force to the base to hold the latter against the support surface when a gymnast is exercising on the bar.

11. The gymnastic device of claim 10 that further includes adjusting means for varying the height of the bar above the support surface.

* * * * *